US006113073A

United States Patent [19]

Lefavour et al.

[11] Patent Number: 6,113,073

[45] Date of Patent: Sep. 5, 2000

[54] HYDRAULIC SPIKE PULLER WITH FRICTIONALLY DELAYED MOVING JAWS AND BLOCKING JAW FRONT SHAPE

[75] Inventors: John David Lefavour, Litchfield; Raymond G. Lavoie, Pembroke, both of N.H.

[73] Assignee: Framatome Connectors USA, Inc., Etters, Pa.

[21] Appl. No.: 09/338,417

[22] Filed: Jun. 22, 1999

[51] Int. Cl.[7] ..... B25C 11/00

[52] U.S. Cl. ..... 254/18; 254/22; 254/24

[58] Field of Search ..... 254/18, 22, 24

[56] References Cited

U.S. PATENT DOCUMENTS

| | | | |
|---|---|---|---|
| 925,557 | 6/1909 | Bramstadt | 254/18 |
| 3,643,918 | 2/1972 | Ellis . | |
| 3,746,306 | 7/1973 | Ellis et al. . | |
| 5,253,844 | 10/1993 | Cotic et al. . | |
| 5,524,868 | 6/1996 | Decker et al. . | |
| 5,924,679 | 7/1999 | Wilson . | |

OTHER PUBLICATIONS

1. Advertisement—SP45 Spike Puller, Stanley, Nov. 1992, 1 page.
2. Advertisement—Hydraulic Spike Puller, Racine Hydraulic Tolling, Cat # HSP–1 1998, 1 page.
3. SP45 Spike Puller, Safety, Operation and Maintenance Manual; Stanley; 1992, 19 pages.
4. PCN Publication Change Notice, SP45 Operation & Maintenance Manual, 1995 Stanley, 7 pages.

*Primary Examiner*—David A. Scherbel
*Assistant Examiner*—Lee Wilson
*Attorney, Agent, or Firm*—Perman & Green, LLP

[57] ABSTRACT

A hydraulic spike puller comprising a frame with a chute, a hydraulic drive section connected to the frame, and a spike contacting section connected to the hydraulic drive section and movably located in the chute. The improvement comprises the spike contacting section comprising two jaws pivotably connected to each other and a friction system extending from the jaws and contacting opposite interior sides of the chute. The jaws each have a spike contacting claw section which, when the jaws are in an open position, have a back surface adjacent an interior side of the chute to block an area between the chute and the back surface. The claw sections have substantially non-curved bottom faces which, when the jaws are in the open position, can push a spike out of the chute. The claw sections are shaped to prevent a spike from being caught between the chute and the back surfaces of the claw sections.

11 Claims, 4 Drawing Sheets

HYDRAULIC SPIKE PULLER WITH FRICTIONALLY DELAYED MOVING JAWS AND BLOCKING JAW FRONT SHAPE

BACKGROUND OF THE INVENTION

1. Field of the Invention

The present invention relates to tools with jaws and, more particularly, to a hydraulic spike puller.

2. Prior Art

Racine, a division of Framatome Connectors USA, Inc. sells a hydraulic spike puller under the catalog No. HSP-1. A curved jaw surface allows spikes to wedge between the jaw surface and the chute. Such wedging destroys the chute. Jaws must be at the end of the pull stroke to release the spike from the jaws. When the jaws are at the end of the pull stroke, linkage bumpers force the jaws open. The disadvantage to such a mechanism is that the operator must wait for the tool to fully cycle, release the spike and then reposition the tool for the next pull. Jaws close at a down home position as a result of gravity. To grab a spike the jaws must be forced open. Forcing the jaws open is accomplished by slamming the tool and jaws down onto the spike. As a result, jaws are often damaged. In addition such action fatigues the operator. Jaws may not close fully on the spike prior to pull stroke movement. The closing action of the jaw is dependent on the weight of the jaws. If the jaws do not close freely then the spike is difficult to grab and will not be extracted. A chute with an open window design also has a pinch point. Stanley sells a hydraulic spike puller under the designation SP45100A and SP45101A. Stanley also sells an upgrade kit (No. 28647) to convert the SP45100A and SP45101A to SP45100B and SP45101B model hydraulic spike pullers having spring biased members extending from the pivot pin of the jaws.

SUMMARY OF THE INVENTION

In accordance with one embodiment of the present invention, a hydraulic spike puller is provided comprising a frame with a chute, a hydraulic drive section connected to the frame, and a spike contacting section connected to the hydraulic drive section and movably located in the chute. The improvement comprises the spike contacting section comprising two jaws pivotably connected to each other and a friction system extending from the jaws and contacting opposite interior sides of the chute. The jaws each have a spike contacting claw section which, when the jaws are in an open position, have a back surface adjacent an interior side of the chute to block an area between the chute and the back surface. The claw sections have substantially non-curved bottom faces which, when the jaws are in the open position, can push a spike out of the chute. The claw sections are shaped to prevent a spike from being caught between the chute and the back surfaces of the claw sections.

In accordance with another embodiment of the present invention, a hydraulic spike puller is provided comprising a frame, a hydraulic drive section connected to the frame, and a spike contacting section connected to the hydraulic drive section, the spike contacting section comprising two jaws pivotably connected to each other by a pivot pin, the two jaws being separately connected to a drive rod of the hydraulic drive section by two links pivotably mounted to respective ones of the jaws. The improvement comprises a friction system extending through the pivot pin. The friction system comprising two friction members biased by a spring in opposite directions against inside surfaces of the frame. When the hydraulic drive initially moves the drive rod from one motion state to another motion state, the two links both rotate and translate, and the two jaws merely initially rotate without translation.

In accordance with another embodiment of the present invention, a hydraulic spike puller is provided having a hydraulic drive section with a drive rod, and a spike pulling section connected to the hydraulic drive section. The spike pulling section comprises a chute having a housing and at least one window cover attached to the housing over a side aperture into the housing; and a jaw assembly movably located in the chute, the jaw assembly having a pair of pivotably connected jaws which are connected to the drive rod by a pair of links. The jaw assembly further comprises a friction system connecting the jaws to the chute. The friction system comprises at least one friction member biased by a spring against an inside surface of the at least one window cover.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
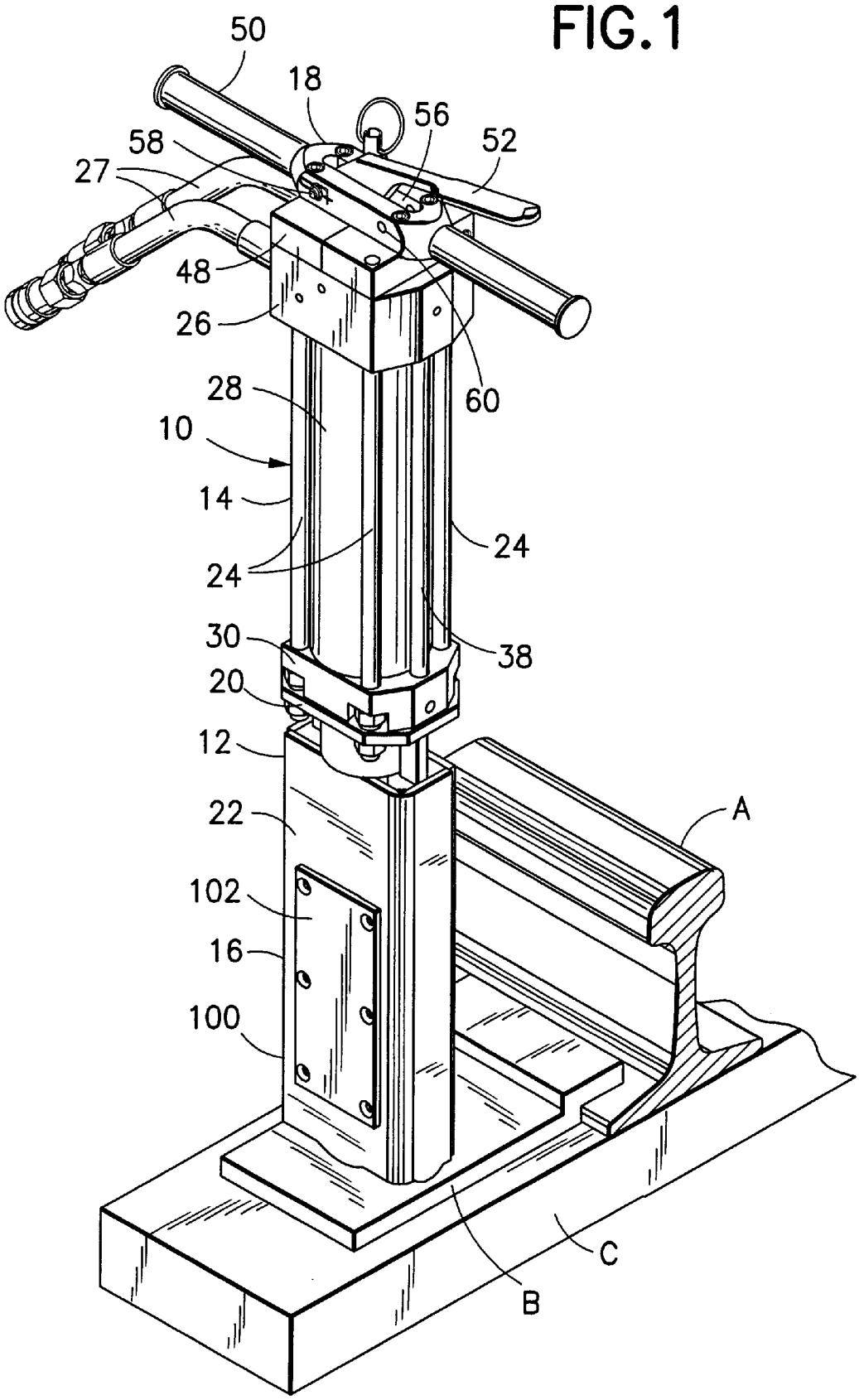
FIG. 1 is a perspective view of a hydraulic spike puller incorporating features of the present invention shown on a railroad tie next to a railroad rail.

Referring to FIG. 1, there is shown a perspective view of a tool 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

Figure 2B:
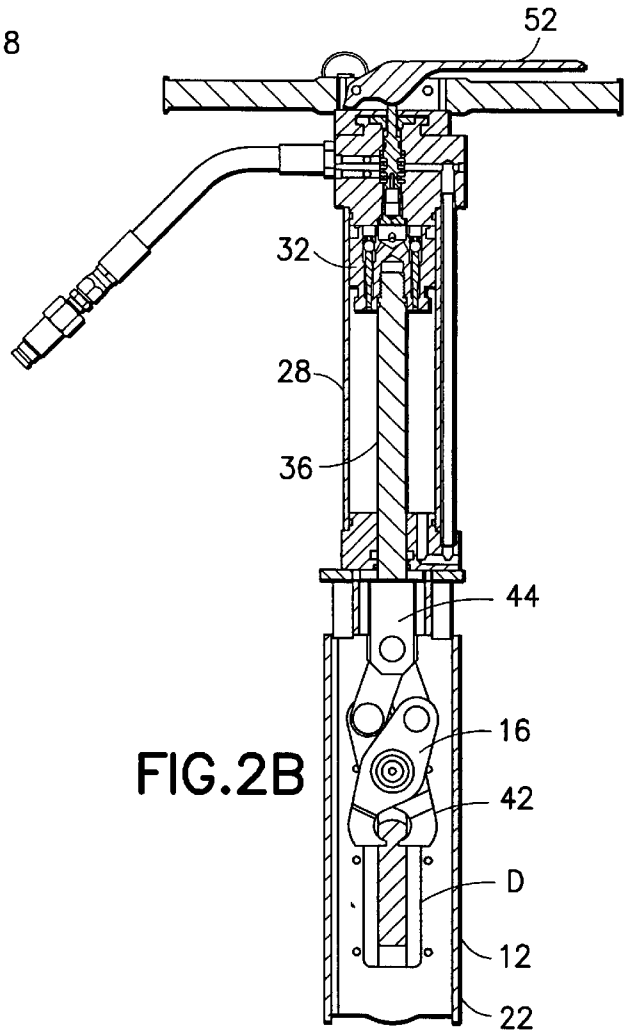
FIG. 2B is a schematic cross-sectional view as in FIG. 2A with the jaws in the retracted position.
Figure 2A:
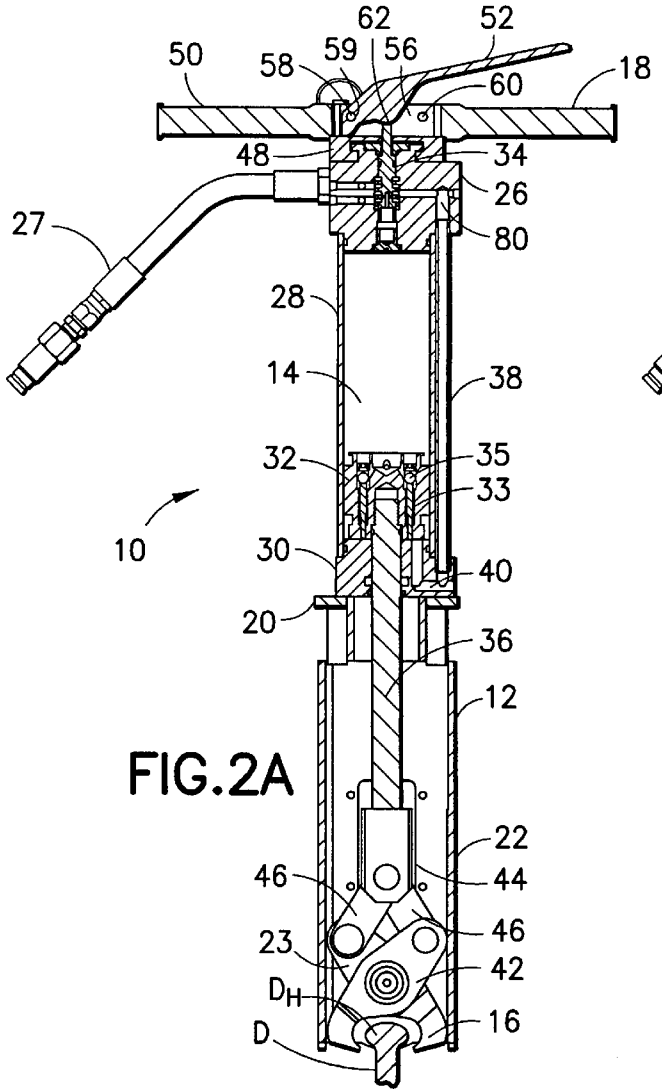
FIG. 2A is a schematic cross-sectional view of the spike puller shown in FIG. 1 with the jaws at a home position.

In this embodiment the tool 10 is a hydraulic spike puller for pulling railroad spikes, such as when a railroad tie or rail is being replaced. However, in alternate embodiments features of the present invention could be used in alternative types of tools. The tool 10 generally comprises a frame 12, a hydraulic section 14, a spike pulling section 16, and an assembly 18. FIG. 1 shows the tool 10 next to a railroad rail A, on a rail plate B and railroad tie C. As is known in the art a railroad spike D (see FIG. 2A) is used to attach the rail plate B to the railroad tie C. The tool 10 is used to remove the spike D from the railroad tie C. Different types of rail plates and railroad spikes are known in the art. Jaws of the tools 10 may be configured for specific types of applications, such as for use with hair-pin types of spikes. FIG. 2A shows a portion of a spike D intended to be pulled from a railroad tie by the tool 10. The tool 10 is positioned over the head $D_H$ of the spike D as shown in FIG. 2A with a part of the frame 12 resting against the rail plate B.

Referring also to FIG. 2A, the frame 12 generally comprises a middle section 20, a chute 22, and structural bars 24. The chute 22 generally comprises a chute housing 100 and two window covers 102. The chute housing 100 has two apertures located on opposite sides of the housing 100 which extend into the hollow interior of the housing 100. The two covers 102 are removably connected to the housing 100 over the side apertures. The covers 102 can be removed to replace the jaw assembly of the spike contacting section 16. However, any suitable type of chute could be provided. The hydraulic drive section 14 is mounted to the frame 12 by the middle section 20 and the structural bars 24. The hydraulic drive section 14 generally comprises a manifold member 26, a main tube 28, a bottom member 30, a piston member 32, a valve member 34, a connecting bar 36, and a supply tube 38. Two hoses 27 (a hydraulic fluid supply hose and a hydraulic fluid return hose) are connected between the manifold member 26 and a hydraulic pump (not shown) for supplying hydraulic fluid to drive the tool 10.

As seen best in FIG. 2A, the main tube 28 is connected between the manifold member 26 and the bottom member 30. The piston member 32 is movably mounted in a hydraulic fluid receiving area in the main tube 28 between a down position shown in FIG. 2A and an up position shown in FIG. 2B. The manifold member 26 has conduits therethrough. The supply tube 38 is connected between a conduit 80 in the manifold member 26 and a conduit 40 in the bottom member 30 which opens into the hydraulic fluid receiving area of the main tube 28. The drive rod 36 movably extends through the bottom member 30 and connects the piston member 32 to the jaw assembly of the spike pulling section 16. In alternate embodiments other types of drive sections or hydraulic conduiting could be provided.

The assembly 18 is a combined handle and control actuator assembly. However, in an alternate embodiment the user actuated control might be separate from the handle. The assembly 18 generally comprises a cap 48, a handle 50, and a user actuated control lever 52. The cap 48 is rotatably mounted on a post of the manifold member 26. The handle 50 is fixedly attached to the cap 48. In this embodiment the handle 50 is a two-hand "T" type of handle, but other handle shapes could be used. The lever 52 is pivotably mounted to the handle 50 in a center groove 56 by a pin 58 at holes 59 in the handle. The handle has another set of holes 60, and the pin 58 is removable, such that the lever 52 can reversed 180° relative to the handle to accommodate left hand or right hand users. The lever 52 has a valve contact area 62 for contacting the top end of the valve member 34. The assembly 18 is described in more detail in U.S. patent application Ser. No. 09/283,270 which is hereby incorporated by reference in its entirety. However, in alternate embodiments other types of user interfaces or controls could be provided.

The spike contacting section 16 generally comprises two tongs or jaws 42 pivotably connected to each other. The lower ends of the jaws 42 are designed to contact the spike D. The upper ends of the jaws 42 are pivotably connected to the pull member 44 by connecting links 46. The pull member 44 is connected to the drive rod 36. As seen in comparing FIG. 2A to FIG. 2B, when the pull member 44 is pulled upward, the jaws 42 move towards a grasping position to grasp onto the spike. In alternate embodiments other types of spike contacting sections could be provided.

Figure 3:
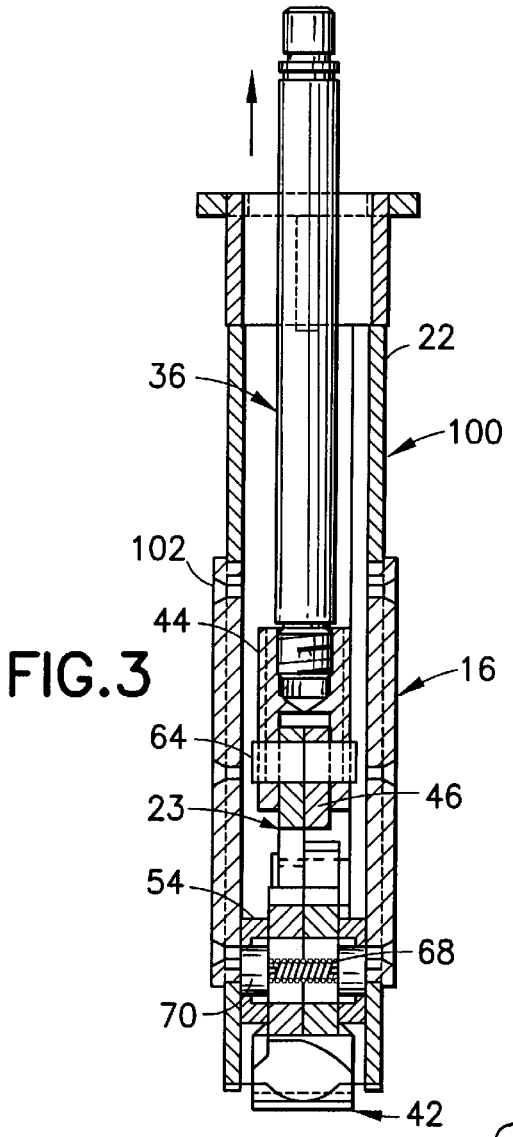
FIG. 3 is a cross-sectional view of the spike pulling section shown in FIG. 2A.
Figure 4:
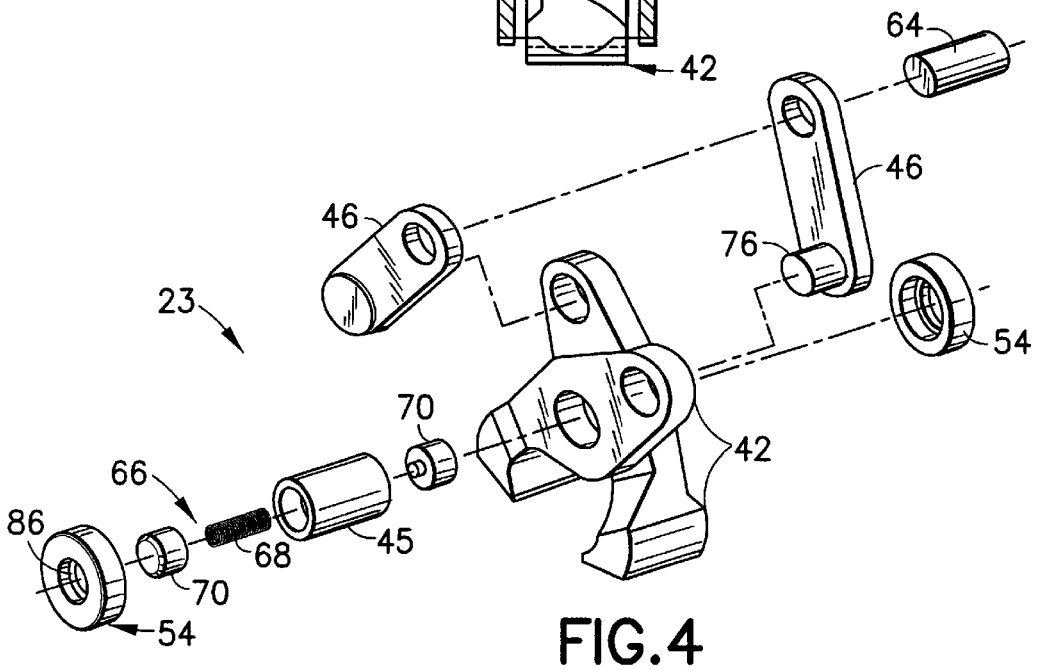
FIG. 4 is an exploded perspective view of the jaw assembly shown in FIGS. 2A, 2B and 3.
Figure 5A:
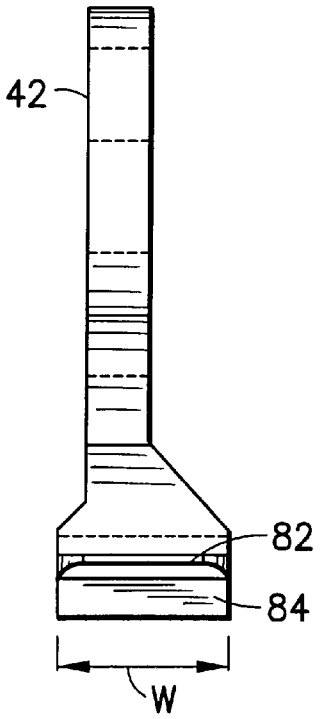
FIG. 5A is an elevational view of one of the jaws shown in FIG. 4.
Figure 5B:
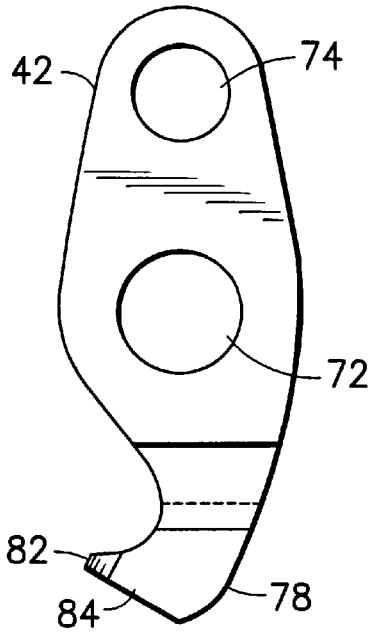
FIG. 5B is an elevational view of the jaw shown in FIG. 5A.

Referring also to FIGS. 3 and 4, the spike pulling section 16 generally comprises the chute 22 and the jaw assembly 23. The jaw assembly 23 generally comprises the two jaws 42, a pivot pin 45, the two links 46, two spacer caps 54, a connecting pin 64, and a friction system 66. The friction system 66 generally comprises a spring 68 and two friction caps 70. The jaws 42 and links 46 form a general movable parallelogram structure. Referring also to FIGS. 5A and 5B, the two jaws 42 are substantially the same; merely connected to each other in opposite orientations. However, in alternate embodiments any suitable shape of jaws could be provided. The jaws each have a center hole 72 which the pivot pin 45 is located in and a top hole 74 which pivot sections 76 of the links 46 are located in. The bottom of the jaws 42 form spike contacting claw sections. The bottom of the jaws 42 have a back surface 78, a wedge shaped tip 82 on an opposite side, and a bottom face 84 which is preferably flat. The bottom of the jaws 42 also have a width W which is preferably about the same width as the interior width of the chute 22. The links 46 are pivotably connected to the jaws 42 by their pivot sections 76. The links 46 are also pivotably connected to the pull member 44 by the connecting pin 64. The pull member 44 is fixedly connected to the drive rod 36. The two spacers 54 are mounted on the opposite ends of the pivot pin 45 and keep the centers of the jaws spaced from the interior walls of the chute 22. The pivot pin 45 has a passage therethrough. The spring 68 is located in the passage. The two friction caps 70 are connected to opposite ends of the spring 68 and extend out of the opposite ends of the pivot pin 45. The spacers 54 each have a general ring shape with a center aperture 86. The friction caps 70 extend through the apertures 86 and contact opposite interior sides of the chute 22 and, more particularly, the interior sides of the window covers 102. The spring 68 is compressed such that the friction caps 70 are biased against the window covers 102.

The friction system 66 functions as a means for keeping the jaws 42 in an open position as the jaws are moved from the up position to the home position shown in FIG. 2A after a spike has been pulled. Initially, a user places the tool 10 over the spike D as illustrated in FIG. 2A with the jaw assembly 23 in the open home position as shown. When the user depresses the control lever 52 the piston member 32 is moved upward by hydraulics and pulls the rod 36 upward. The links 46 are pulled upward and rotate pulling the upper ends of the jaws 42 towards each other. The friction system 66 keeps the centers of the jaws fixed relative to the chute 22 such that the jaws 42 only initially rotate and do not translate relative to the chute 22. Thus, the wedge shaped tips 82 of the jaws 42 are able to rotate under the head $D_H$ of the spike S. When the jaws 42 are stopped by the spike D from further rotation, the upward movement of the rod 36 overcomes the frictional forces of the friction system 66 and the jaw assembly 23 translates upward along the interior of the chute 22 pulling the spike with it. The friction caps merely slide along the interior surfaces of the covers 102.

When the user releases the central lever 52 the piston member 32 is moved downward back towards its home position. Initially, the friction system 66 holds center of the jaws 42 fixed relative to the chute 22 such that the jaws 42 only initially rotate without translation relative to the chute 22. The links 46 initially both rotate and translate to move the jaws 42 to an open position. As the jaws 42 are opened, the spike D is able to fall away. The jaws 42 stop rotating and start translating down the chute 22 when the back surfaces 78 of the jaws'bottom ends contact the opposite interior sides of the chute housing 100. Alternatively, jaws 42 may be designed to stop opening with the back surfaces 78 in very close spaced proximity adjacent the opposite interior sides of the chute housing 100. In any event, the bottoms of the jaws 42 substantially block an area between the chute and the back surfaces 78 to prevent the spike D from entering this area. After the jaws 42 open the downward movement of the rod 36 moves the jaws 42 downward back to their home position while maintaining jaws in their open position along this home returning movement.

A problem which can be encountered is when a dropped spike D is still inside the chute 22 while the jaw assembly is being returned to its home position. In the prior art, because the jaws were not always maintained in an open position during their home returning movement (usually closing because of gravity or being wedged closed by the spike contacting a rounded or curved bottom surface of the jaws) the spike could get wedged between the chute and the back surface of the jaws. This would result in the jaws not being able to open properly and the user having to clean out the spike manually. The friction system 66 helps to prevent this from occurring. However, as noted above, the bottom surfaces 84 are also preferably provided as being flat; or at least not being curved as in the prior art. The combination of the flat surface 84 and the friction system 66 combine to:

1. prevent gravity from closing the jaws 42 as the jaws are being returned to their home position; and 2. prevent a spike D in the chute 22 wedging itself between the chute and the back surface 78 even when the jaws are initially open.

Figure 6:
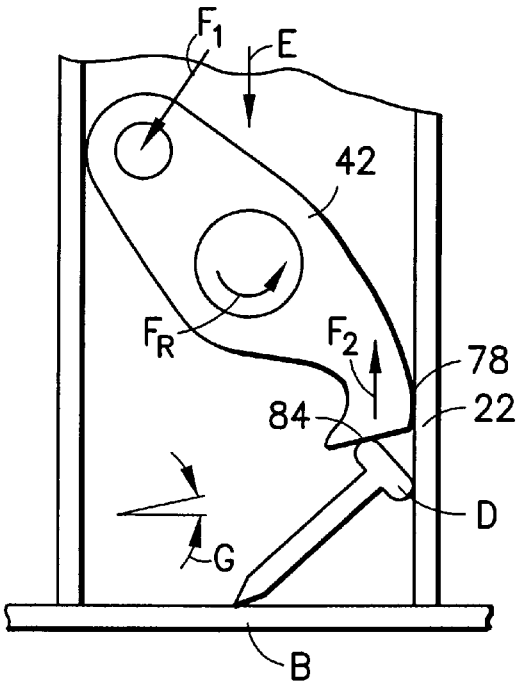
FIG. 6 is a schematic view of one of the jaws in an open position in the chute with a spike in the chute on a rail plate.

At the instant the operator releases the actuating trigger, the hydraulic cylinder rod reverses direction and travels toward the home position. The instant the hydraulic cylinder rod reverses direction, the jaws open and the spike is released. Once again there is some dwell time which allows the spike to fully release prior to any linear movement of the jaws. This action allows the operator to release a spike at any time during operation. When the jaws reach their home position the jaws remain open and are thus the tool is staged to grab the next spike. The jaws are designed with a flat face. This flat face forces the spike out of the chute. When the operator releases the actuating trigger, the hydraulic cylinder rod reverses direction, the jaws open, the spike is dropped and the hydraulic cylinder pushes the jaw assembly towards the home position. There are two possible scenarios that may result. The first is that the operator will lift the spike puller up off the rail plate and allow the spike to "fall clear" of the chute. The other scenario is that the operator does not lift the tool of off the rail plate and the spike remains trapped inside the chute (this was a bad situation on the "traditional design" tool.) With the "new design" the flat face jaws force the spike clear of the chute. The flat face jaws expel the spike from the chute by first pushing on the spike and forcing the whole tool to lift off of the rail plate. The spike is then expelled. This feature can prevent chute damage. The jaw geometry and the linkage mechanism orient forces to push the spike clear of the chute. These forces create a couple (rotational force) in the counter clockwise direction oil the jaw as shown in FIG. 6. The other jaw (not shown) would experience a clockwise couple. As illustrated in FIG. 6, wherein only one jaw is shown for the sake of clarity, if a spike D is still inside the chute 22 as the jaws 42 move down as indicated by arrow E, the spike D can get caught between the bottom surface 84 and the rail plate B. The spike D will exert a force $F_2$ on the jaw 42. However, because of the non-curved shape of the bottom surface 84, because of its angle G, which is close to horizontal, and because the area between the back surface 78 and the chute 22 is substantially blocked, the spike cannot overcome the rotational force $F_R$ created by force $F_2$ and by force $F_1$ from the jaw's link 46. Thus, the jaw assembly 23 is continued to be pushed downward, with the jaws remaining open, causing the spike D to be pushed out of the chute 22; if necessary the tool and chute 22 being raised by hydraulic pressure off of the plate B.

The present invention provides a new jaw profile with a flat faced jaw which forces the spike out of the chute. When a spike is released inside the chute the flat face jaw in combination with the friction cap and links force the jaw to stay fully opened. Spikes cannot wedge between the jaw and the chute. Spikes are forced out of the chute.

The operator may release a spike at any time during the pull stroke cycle or cylinder rod retraction. The operator can release the control handle and the cylinder rod will immediately reverse direction and travel towards the home position. At that instant, the dynamics of the jaws reverse. The jaws open fully prior to translating with the cylinder rod. The spike is fully released. As the jaws translate to the home position the jaws remain in the open position.

The friction caps create drag. Such drag creates the desired Jaw/Linkage action. The jaws at the home position remain open and are always ready to grab a spike. When the tool is actuated the cylinder rod starts to retract (pull stroke). At that instant the linkages start to translate with the cylinder rod. Initially the jaws rotate closed, however, do not translate with the cylinder rod until the jaws close or grasp the spike. Such action provides a "dwell" time for the jaws to grip the spike. The cylinder rod preferably moves approximately 0.62 inches for the jaws to rotate fully closed.

The covered access windows provide a service entrance for changing of the jaws. The jaws may be easily changed for "cut" spikes or "hairpin" style spikes. The window covers are preferably screwed on.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In a hydraulic spike puller comprising a frame, a hydraulic drive section connected to the frame, and a spike contacting section connected to the hydraulic drive section, the spike contacting section comprising two jaws pivotably connected to each other by a first pivot pin, the two jaws being separately connected to a drive rod of the hydraulic drive section by two links pivotably mounted to respective ones of the jaws, said links being pivotably connected to said drive rod through a second pivot pin, wherein a friction system extends through the first pivot pin, the friction system comprising two friction members biased by a spring in opposite directions against inside surfaces of the frame, wherein when the hydraulic drive initially moves the drive rod from one motion state to another motion state the two links both rotate and translate, and the two jaws merely initially rotate without translation, wherein the friction system further comprises two spacers located between the jaws and the frame, and wherein the spacers have a general ring shape with the friction members extending through center holes of the general ring shaped spacers.

2. A spike puller as in claim 1 wherein the frame comprises a chute housing and window covers attached to the chute housing over side apertures through the chute housing, wherein the two friction members ride against the window covers.

3. A spike puller as in claim 1 further comprising a spacer cap between the chute and the jaws with a hole having the friction member extending through the hole.

4. A spike puller as in claim 1 wherein the frame has a chute, wherein the spike contacting section is connected to the hydraulic drive section and is movably located in the chute, and wherein the jaws each have a spike contacting claw section which, when the jaws are in an open position, have a back surface adjacent an interior side of the chute to block an area between the chute and the back surface.

5. A spike puller as in claim 4 wherein the claw sections have substantially non-curved bottom faces which, when the jaws are in the open position, can push a spike out of the chute.

6. A spike puller as in claim 5, wherein the claw sections are shaped to prevent a spike from being caught between the chute and the back surfaces of the claw sections.

7. A hydraulic spike puller having a hydraulic drive section with a drive rod, and a spike pulling section connected to the hydraulic drive section, the spike pulling section comprising:

a chute having a housing and at least one window cover attached to the housing over a side aperture into the housing; and a jaw assembly movably located in the chute, the jaw assembly having a pair of pivotably connected jaws which are connected to the drive rod by a pair of links, wherein the jaw assembly further comprises a friction system connecting the jaws to the chute, wherein the friction system comprises at least one friction member biased by a spring against at least part of said housing.

8. A spike puller as in claim 7 wherein said housing comprises a frame and at least one window cover attached to the frame over a side aperture through the chute housing, wherein one of said friction members ride against the window cover.

9. A spike puller as in claim 8 wherein the chute housing has two of the side apertures and two of the window covers, and wherein the friction system has two of the friction members biased against the two respective window covers.

10. A hydraulic spike puller comprising a frame, a hydraulic drive section connected to the frame, and a spike contacting section connected to the hydraulic drive section, wherein the spike contacting section comprises two jaws pivotably connected to each other by a first pivot pin, the two jaws being separately connected to a drive rod of the hydraulic drive section by two links pivotably mounted to respective ones of the jaws, the links being pivotably connected to the drive rod through a second pivot pin, wherein the frame comprises a chute housing and window covers attached to the chute housing over side apertures through the chute housing, and wherein the two friction members ride against the window covers.

11. A hydraulic spike puller comprising a frame, a hydraulic drive section connected to the frame, and a spike contacting section connected to the hydraulic drive section, wherein the spike contacting section comprises two jaws pivotably connected to each other by a first pivot pin, the two jaws being separately connected to a drive rod of the hydraulic drive section by two links pivotably mounted to respective ones of the jaws, the links being pivotably connected to the drive rod through a second pivot pin, and wherein the spike puller further comprising a spacer cap between the chute and the jaws with a hole having the friction member extending through the hole.

* * * * *